US005537753A

United States Patent [19]

Otte et al.

[11] Patent Number: 5,537,753

[45] Date of Patent: Jul. 23, 1996

[54] BORE HOLE INCLINOMETER APPARATUS

[76] Inventors: Hubert J. Otte, 74 Spadina Road #603, Toronto, Ontario, Canada, M5R 2T5; Gosta Roosman, 2920 Lakeshore Blvd., Toronto, Ontario, Canada, M8C 1J3

[21] Appl. No.: 354,246

[22] Filed: Dec. 12, 1994

Related U.S. Application Data

[63] Continuation-in-part of Ser. No. 181,213, Jan. 13, 1994.

[51] Int. Cl.[6] ..... E21B 47/022

[52] U.S. Cl. ..... 33/304; 33/311

[58] Field of Search ..... 33/304, 308, 309, 33/311, 313

[56] References Cited

U.S. PATENT DOCUMENTS

| | | | |
|---|---|---|---|
| 1,845,889 | 2/1932 | Schoolcraft | 33/304 |
| 1,987,696 | 1/1935 | McLaughlin et al. | 33/304 |
| 2,412,976 | 12/1946 | Emerson et al. | 33/309 |
| 2,648,141 | 8/1953 | Hildebrandt | 33/304 |
| 3,845,569 | 11/1974 | Otte et al. . | |
| 4,047,306 | 9/1977 | Otte et al. . | |
| 4,071,959 | 2/1978 | Russell et al. | 33/313 |
| 4,467,526 | 8/1984 | Otte | 33/304 |
| 4,587,871 | 4/1986 | Kathel | 33/304 |

FOREIGN PATENT DOCUMENTS

| | | | |
|---|---|---|---|
| 1502816 | 8/1989 | U.S.S.R. | 33/304 |

OTHER PUBLICATIONS

Diamond Drill Handbook—published by J. K. Smit, 1980 no month pp. 340–343.

*Primary Examiner*—Thomas B. Will

[57] ABSTRACT

A bore hole inclinometer device for use in core drilling employing hollow drill rods, and a core barrel, the device having, an elongated casing dimensioned to fit within the hollow drill rods, and having at its lower end an attachment for a core barrel, and at its upper end, an attachment for the wire by which it is hoisted and lowered through the hollow drill rods, an inclinometer within the casing operable to respond to the inclination of the casing to provide an inclination reading, a sensor for sensing the inclination of the casing and providing an inclination signal proportional to the inclination of the casing, an electrical circuit for powering the inclinometer, for receiving the inclination signal, and, an electrical power supply for powering the electrical circuit.

6 Claims, 7 Drawing Sheets

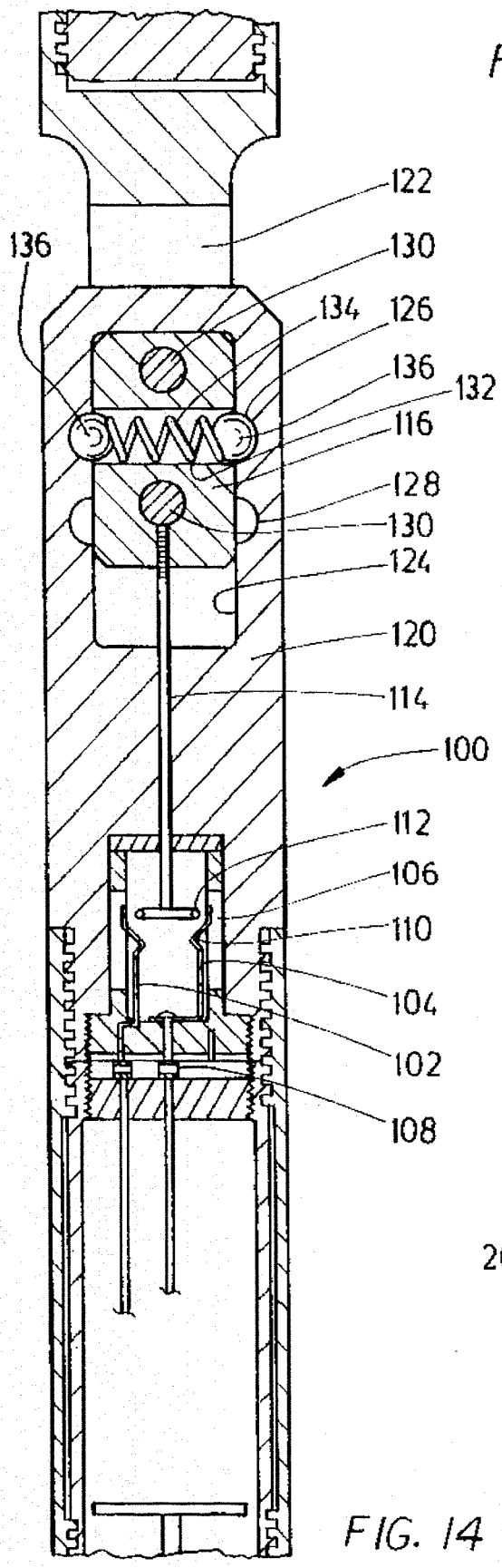
FIG. 14
FIG. 15
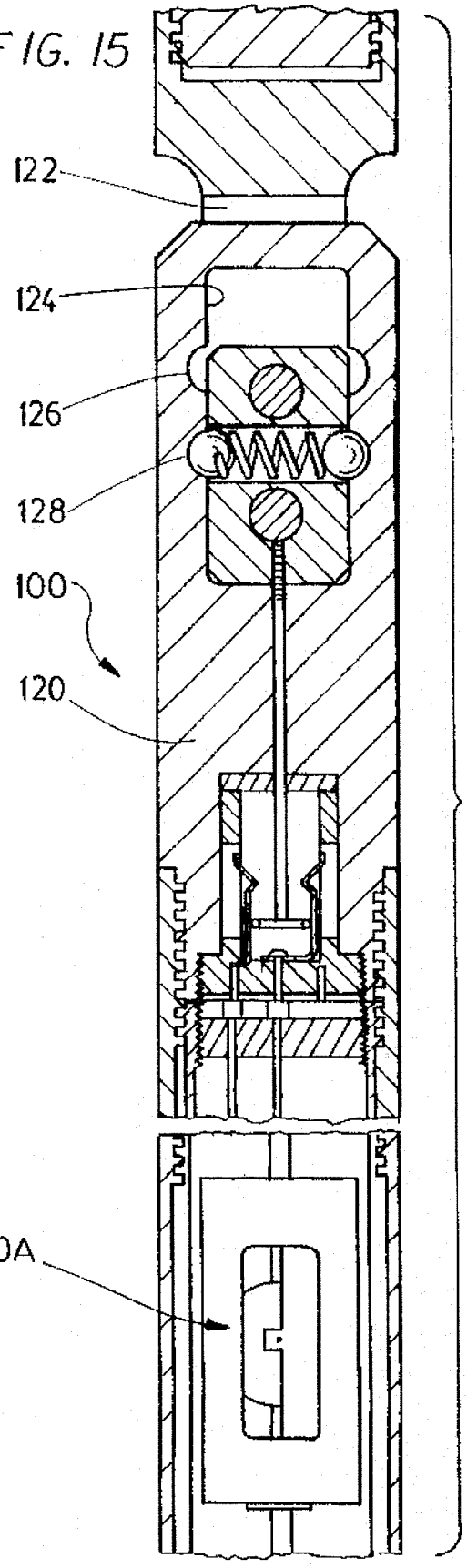

BORE HOLE INCLINOMETER APPARATUS

FIELD OF THE INVENTION

The invention relates to an inclinometer apparatus for bore holes, and in particular to an inclinometer apparatus which can be attached to the wire line used in core drilling, when retrieving the core barrel from the drill rods. This application is a Continuation-In-Part of application Ser. No. 08,181,213 entitled: Bore Hole Inclinometer Apparatus, filed: Jan. 13, 1994, pending Inventors: Hubert J. Otte & Gosta Roosman.

BACKGROUND OF THE INVENTION

In the mining industry, and other industries, it is the practice to drill bore holes into the earths' surface, usually for the purpose of extracting cores to determine the nature and mineral content of the substrate being drilled. Usually this is an ore body. In other cases it may be for purposes of examining the earth to place foundations or the like.

It is well known that when drilling to any significant depth, that the drill has a tendency to wander. As a result, the bore hole is in many cases "off-course" and may define a progressive curve whereas it is desirable that the bore hole should be straight.

The practice in core drilling is to employ a series of lengths of cylindrical drill rod, with the drill bit itself being located at the leading end. The drill bit and the rods are hollow, so that they drill out a core of material which then passes internally along the cylindrical interior. Within the cylindrical interior of the drill rods there is a container known as a core barrel. This core barrel receives the core of material which is drilled out by the drill bit. At periodic intervals for example every six feet or so, the core barrel, containing the core of material, is retrieved from the interior of the cylindrical drill rods, and is logged as to depth and is placed in protective casings for subsequent laboratory examination. The retrieval of the core barrel is achieved by means of a wire line, which has captive means adapted to attach to the upper end of the core barrel, so that the core barrel may be withdrawn by the wire line up through the drill rods. Typically the core barrel will have at its upper end some form of attachment device or abutment, and the wire line will have at its lower end some form of capture device, such as spring-loaded claws or the like. By dropping the wire line and capture device down through the drill rods, the capture device captures the abutment on the upper end of the core barrel. The core barrel may then be withdrawn up through the drill rods. When empty the core barrel may be then be returned down through the drill rods and the wire line capture device can be released, leaving the core barrel in the drill rods to receive another length of core material, as drilling proceeds.

This procedure is described here merely for the sake of completeness. It is a well known practice in the art, and has been carried on in this fashion for many years.

Clearly, it is important to know whether the bore hole has gone in the intended direction or whether it has wandered off course. If it is not straight, but curves away from its intended direction then the cores as they are removed from the drill rods will represent a picture of the sub-strate being drilled which is unpredictable, and may give false information to the scientists studying the sub-strate.

In the past, numerous proposals have been made for providing inclinometers and bore hole logging devices. The intention of these devices was to provide a reading of the inclination of the bore hole, as it progressed into the earth. Examples of such proposals are shown in U.S. Pat. No. 3,845,569 Title: Bore Hole Logging Device, Inventor: H. J. Otte et al, U.S. Pat. No. 4,047,306 title: Bore Hole Probe, Inventor: H. J. Otte et al, and 4,467,5256 title: Inclination Instrument, Inventor: H. J. Otte.

In the first U.S. Patent, the instrument was intended to provide both a compass bearing, and also a reading of the inclination of a location in a bore hole. In this way, the device could simply be passed down the bore hole and readings taken an intervals down the bore hole.

The second U.S. Patent relates to a device for logging a bore-hole, after the drill is removed. It is effective, and is still in use today.

In the third U.S. Patent, the device was intended to be attached to the drill rods, at the top end of the core barrel. While the drill rods rotated, during drilling, the inclinometer would not take a reading. However once the rotation of the drill rods was stopped, when the core barrel was full, the device would then take a reading.

The first device was particularly complex and delicate in design. In addition, it did not totally fulfil the needs of the drilling industry. It is particularly desirable to provide inclination readings as each core is removed from the drill hole. However the device shown in the earlier patent was not intended for this purpose. On the contrary, it was intended to provide readings of the inclination of the bore hole either after drilling had ceased or at intervals during drilling.

The second device was intended for the same purpose as the first, but was a much simpler design, and has achieved a wide degree of acceptance in the field. Both these devices were however not as desirable as one that provided a step-by-step reading as each core was removed.

The device described in the later patent was intended to provide a reading for the inclination of each core just before it was removed. However, it was found in practice that the extreme stresses set up by the rapid rotation of the drill rods and the vibration within the drill rods, and the hostile underground environment all combined to cause relatively rapid failure of various moving parts of the device. Consequently, although in principal the device appeared to satisfy industry objectives and requirements, for a step-by-step reading of each core, it was found that it required major servicing at relatively frequent intervals.

Clearly it is desirable to provide an inclinometer instrument which in the first place does not have to be attached to the drill rods and be subjected to the high speed rotation and vibration occurring during drilling.

Secondly it is desirable to provide an instrument which does not require any additional special operation. In particular it is desirable to provide such an instrument which does not require to be inserted into the bore hole and removed, as a separate operation. It is preferable if the insertion and removal of the instrument can take place as part of the normal sequence of drilling operations.

BRIEF SUMMARY OF THE INVENTION

With a view therefore to satisfying the foregoing objectives the invention comprises a bore hole inclinometer device adapted particularly for use in core drilling employing hollow drill rods, and a core barrel, and said device comprising, an elongated casing dimensioned to fit within said hollow drill rods, and having at its lower end means for attachment to a core barrel, and at its upper end, attachment means whereby the same may by hoisted and lowered through said hollow drill rods, inclinometer means within said casing, operable to respond to the inclination of said casing to provide an inclination reading, and electrical sensing means for sensing the inclination of said casing relative to said inclinometer means, and providing an inclination signal proportional to said inclination of said casing, electrical circuit means for powering said sensing means, and for receiving said inclination signal, and electrical power supply means for powering said electrical circuit means.

A further feature of the invention provides switch means normally disconnecting said power supply means from said electrical circuit means, and said switch means being operable to cause connection of said power supply means to said electrical circuit means, upon connection of said housing with a said core barrel.

A further feature of the invention provides said switch means for connecting the power supply to the electrical circuit means, in the form of a mass of a predetermined size supported by a spring over a microswitch, and the force of the spring being such that upon impact of the device with the core barrel, the mass moves against the force of the spring and activates the microswitch.

A further feature of the invention provides a digital readout of the inclination of said device.

A further feature of the invention provides an on/off switch for activating said digital readout.

A further feature of the invention provides an inclination sensing device wherein said inclination signal is an analogue signal, and wherein said electrical circuit means includes means for converting said analogue signal to a digital signal, and memory means for capturing said digital signal.

A further feature of the invention provides a positive on-off switching of power to the electrical circuit means.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 14 is a section along line 14—14 of FIG. 12, and,

FIG. 15 is a section along line 15—15 of FIG. 13.

DESCRIPTION OF A SPECIFIC EMBODIMENT

Figure 1:
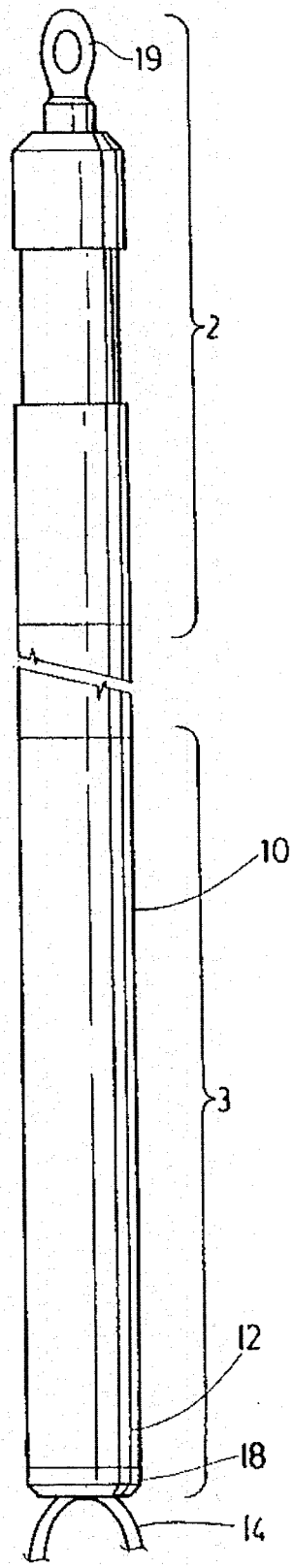
FIG. 1 is a side elevational view partially cut away of an inclinometer device illustrating the invention.
Figure 2:
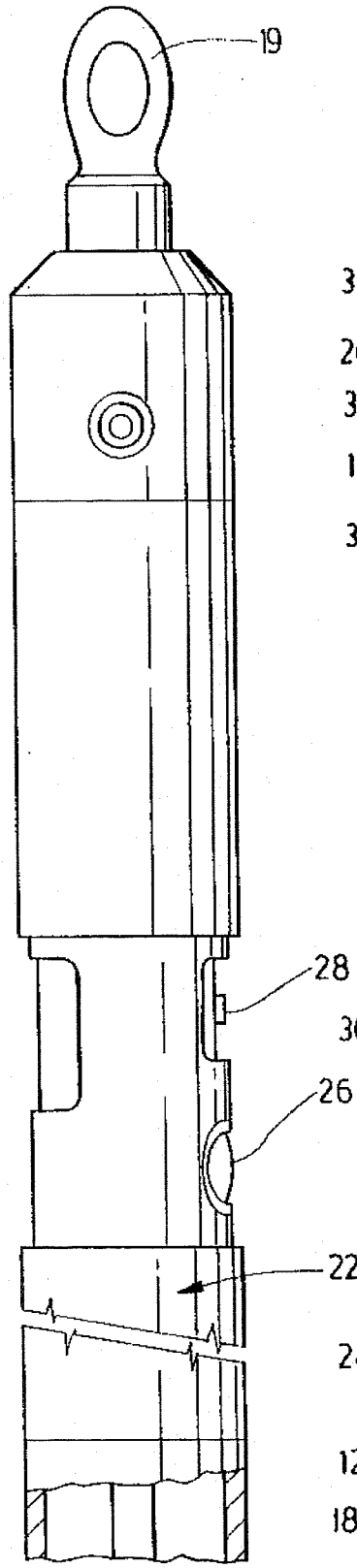
FIG. 2 is an enlarged elevational view of the portion of the device between the bracket 2 of FIG. 1.
Figure 3:
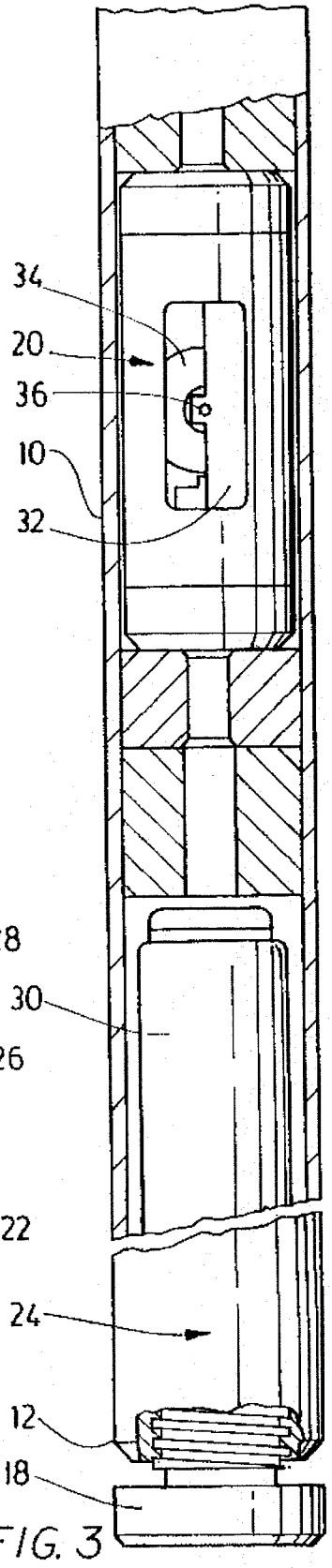
FIG. 3 is an enlarged elevational view of the portion of the device between the bracket 3 of FIG. 1 partially cut away and sectioned.
Figure 4:
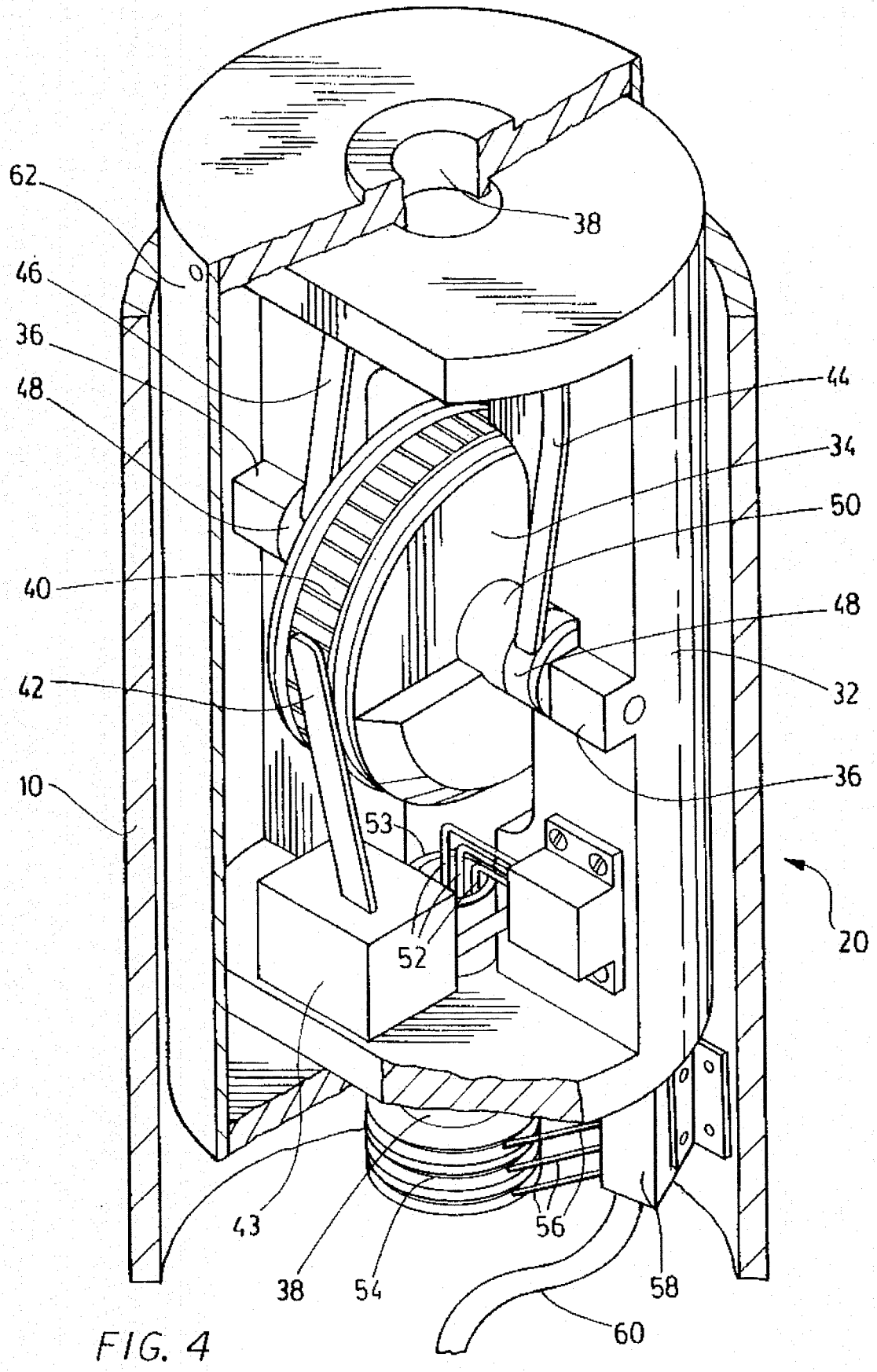
FIG. 4 is a perspective illustration of the inclinometer sensing portion of the device of FIG. 1 partially cut away.
Figure 5:
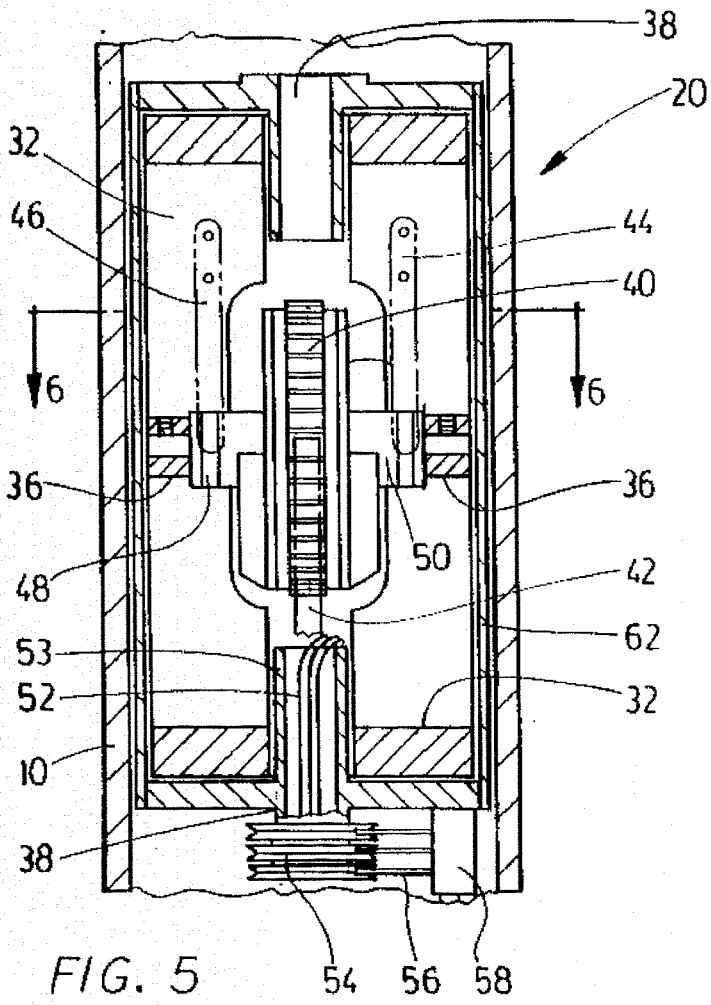
FIG. 5 is a side elevation of the inclinometer sensing portion of the device.
Figure 7:
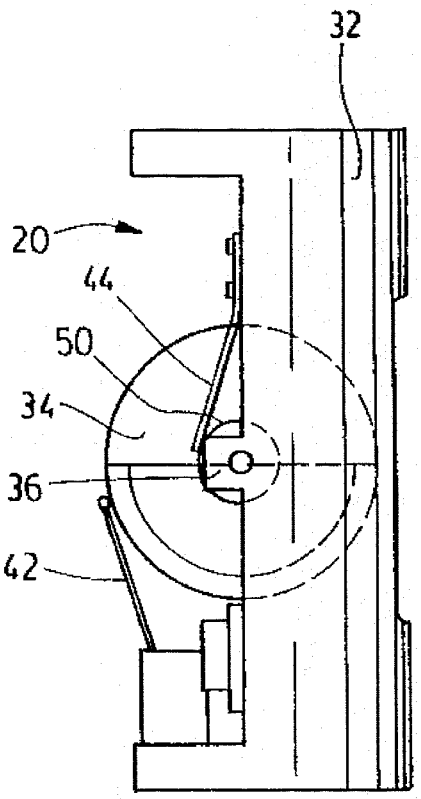
FIG. 7 is a side elevational view of the inclinometer of FIG. 4.
Figure 6:
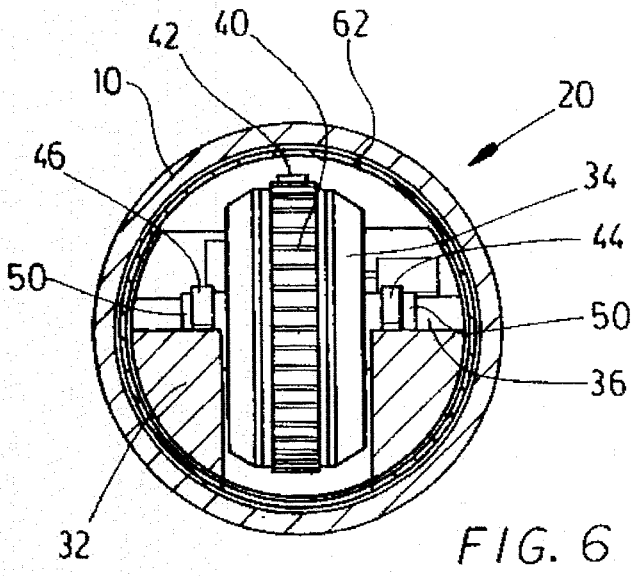
FIG. 6 is a section of the inclinometer sensing device along line 6—6 of FIG. 5.

Referring first of all to FIG. 1 it will be understood, that this illustrates one embodiment of the invention, for the purposes of explaining the invention, and without limitation to the specific features illustrated. In the illustrated embodiment in FIG. 1, a casing 10, which in this case is of cylindrical shape, provided with a lower end 12 which is adapted to be interconnected with a core barrel. Typically the core barrel (not shown), in a manner well known in the art, will have at its upper end an interlocking abutment (not shown). The lower end 12 of casing 10 shown in bracket 3 of FIG. 1 is provided with capture means or claw 14 adapted to interlock with the core barrel abutment. It will be appreciated that the capture means 14 is preferably attached to a threaded member 18 on the lower end 12 of the casing 10. This is because there may be a variety a different designs of core barrels, having different shapes of abutment means or other means for capturing the core barrel, requiring different forms of claw means or other interlocking means. Various different types of such interlocking means can thus be provided on the lower end 12 of the casing 10 to suit the requirements of various customers. An attachment ring 19 is provided at the upper end shown in bracket 2 in FIG. 1.

Within the casing, there is provided, in a plurality of compartments, an inclination sensor unit 20, electrical circuitry 22, a power supply 24, a digital readout 26, a readout switch unit 28, and a trigger switch 30.

The inclinometer sensor unit 20 is best shown in FIGS. 4, 5, 6, and 7. It comprises a more or less semi-cylindrical first body 32, and a cylindrical second body 34 mounted transversely in the first body on bearings 36.

First body 32 is itself mounted for rotation about the longitudinal axis of the casing 10 on bearings 38.

First body 32 is formed in such a way that its centre of gravity is substantially offset from its rotational axis so that even at relatively extreme angles of tilt of the casing 10, the first body 32 will swing until its centre of gravity is located directly below its central axis.

Second body 34 is also formed with its centre of gravity substantially offset from its rotational axis, so that it will swing relative to first body 32, and will adopt a predetermined rotational position.

The first body 32 is free therefore to respond simply to the influence of gravity, and in a short space of time it will adopt a position in which it is stable. The second body 34 will then also respond to the influence of gravity and swing until it too is stable.

In order to take a reading from the second body 34, the second body 34 is provided with electrical sensing means comprising an annular wire resistance coil 40 located on the outer surface of the body 34. An electrical contact probe 42 is mounted on block 43, on first body 32 and extends towards the second body, to contact the wire resistance coil 40.

The contact is so designed that it applies very little pressure to the wire coil 40, so that the second body is free to rotate virtually without resistance from friction.

The wire coil 40 functions as a potentiometer, and has two ends connected to the electrical circuitry, by contacts 44 and 46. Contacts 44 and 46 run in grooves 48, formed in hubs 50 of body 40.

Wires 52 extend from first body 32, through axial sleeve 53, and connect with three separate contact slip rings 54. Three electrical contacts 56 are mounted on mounting body 58 secured to the inner side wall of the casing 10.

Cable 60 connects to the electrical circuitry and both supplies power, and receives signals.

Thus the wire coil 40, and the contact probe 42 together provide a means for electrically sensing the position of the casing relative to the second body 34, thereby giving a reading of the inclination of the casing.

To protect and enclose the sensor unit 20, an inner housing 62 of generally cylindrical shape is provided.

Figure 8:
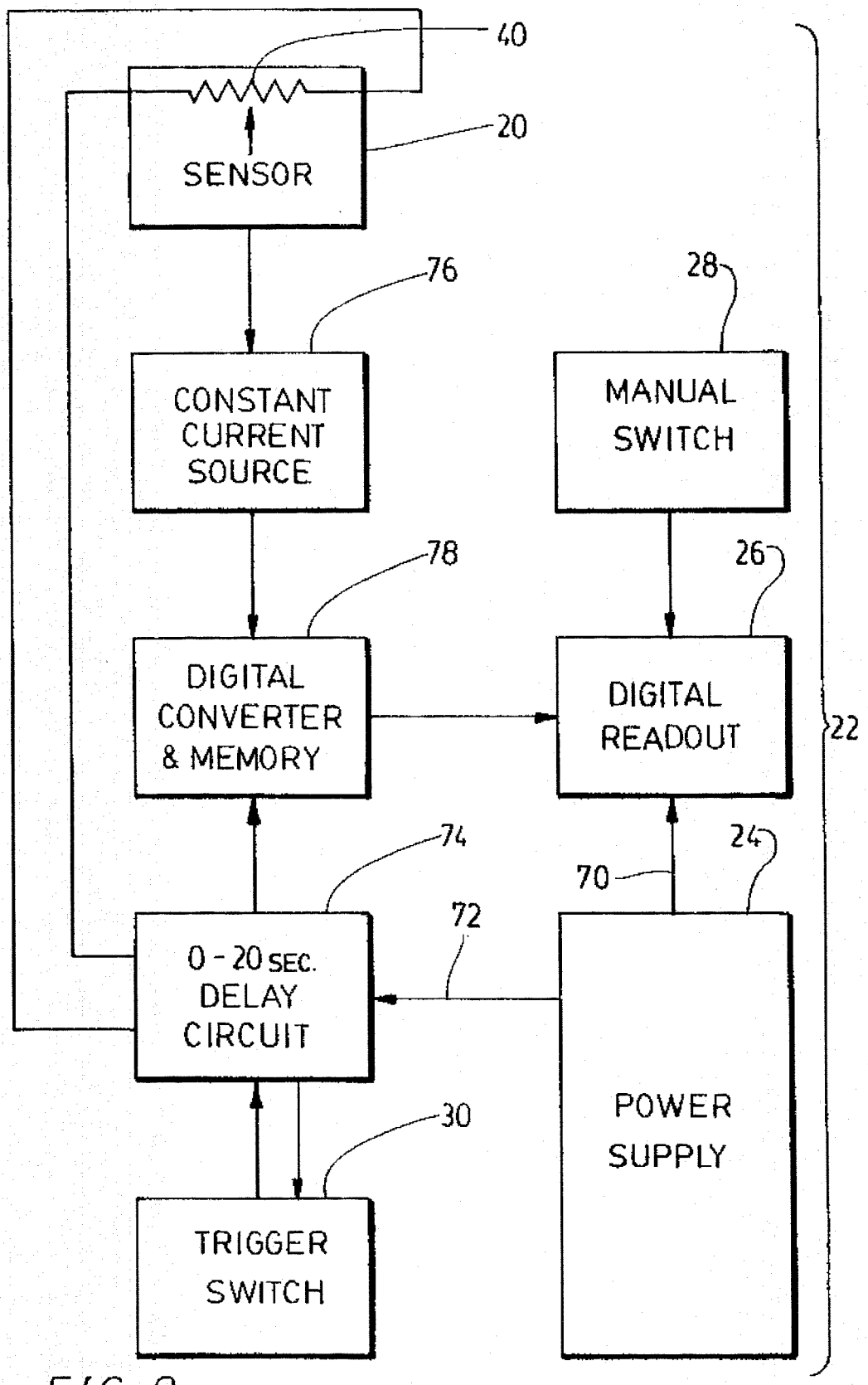
FIG. 8 is a block circuit diagram of the electrical circuits and controls of the device of FIG. 1.

The electrical circuitry is best shown in FIG. 8. It comprises connections 70 and 72 from power supply 24. Typically the power supply is contained in the casing 10 although other arrangements are possible. Even an external power source on the surface, might be desirable. The remainder of the circuit is shown in block diagram form, and comprises the trigger switch 30 (the details which are described below) and a delay circuit 74 connected to wire coil 40 in sensor 20.

The constant current source 76 receives the voltage readout from coil 40. This voltage readout is an analogue signal, and it is converted to a digital signal in the signal converter and memory 78. From the signal converter 78, the signal is then supplied to the digital readout 26. Readout 26 is an LED device, and is separately powered by the power supply. An on/off switch 28 is provided so that the digital readout 26 is normally deactivated, and is only momentarily activated, manually when an operator is actually taking a reading, in order to save power.

The delay circuit 74, in a typical case may delay the response of the digital signal converter 78, up to about twenty seconds or so if required. This is to give the inclinometer first and second bodies 32 and 34 sufficient time to come to rest, so that both the first and the second bodies are stationary, thereby ensuring that an accurate reading is taken, by the contact probe 42 contacting the wire coil 40. Since the wire coil 40 functions as a potentiometer, the signal will be proportional to the distance of the probe 42 to either end of the coil 40.

In order to prevent a reading being taken until the instrument is at the desired location, ie. has been coupled to the upper end of a core barrel, the trigger switch 30 is provided in the circuit between the power source and the inclinometer sensing unit.

Figure 9:
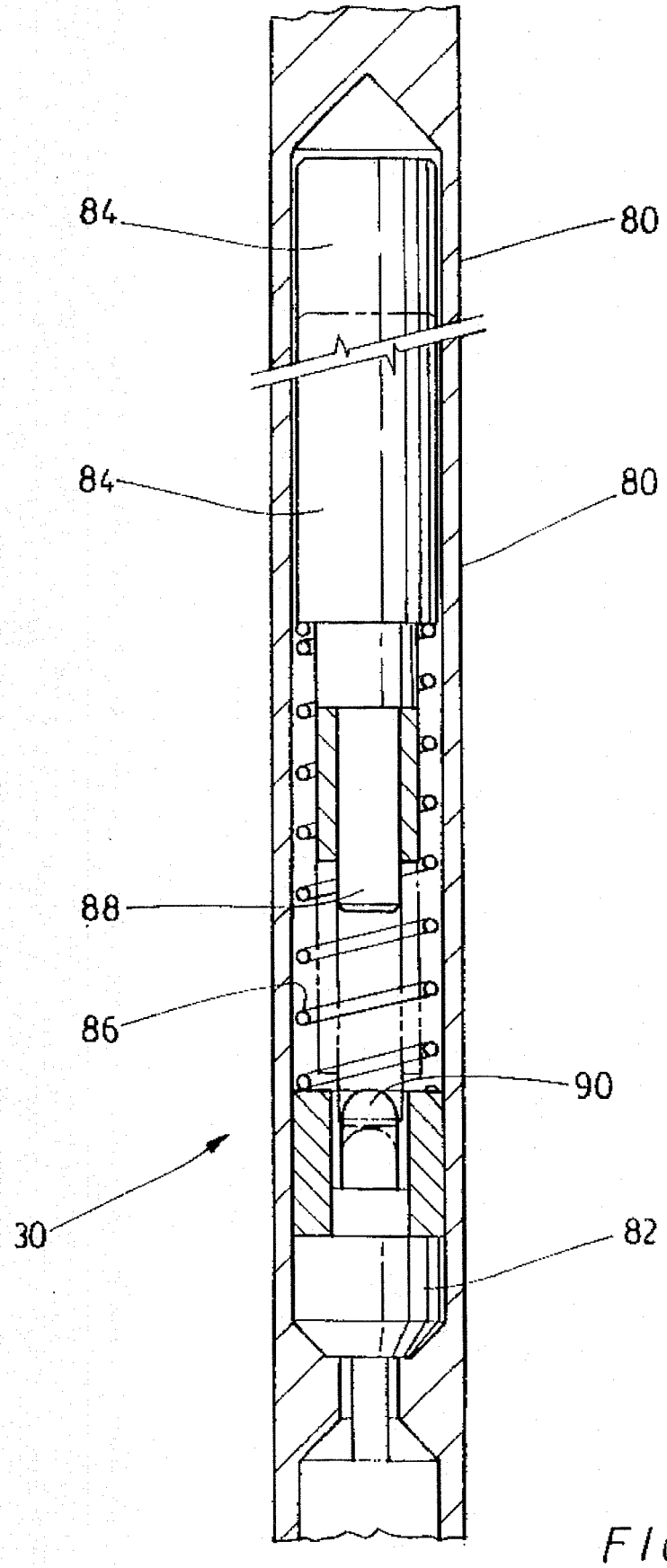
FIG. 9 is a section of the trigger switch, showing movement in phantom.
Figure 10:
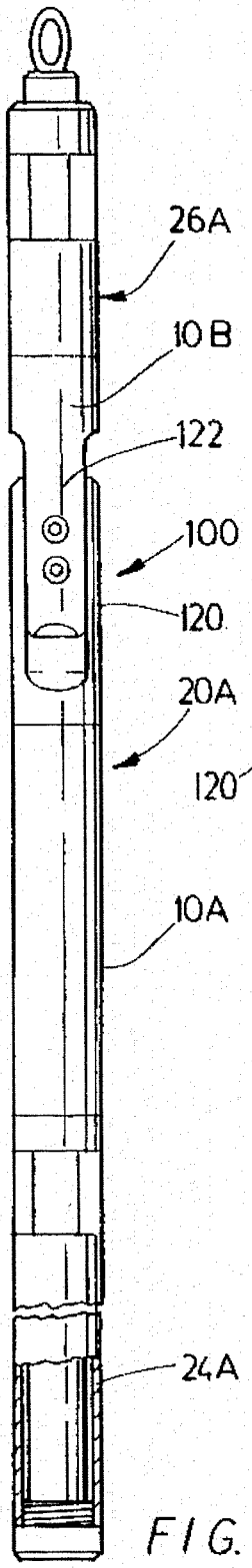
FIG. 10 is a side elevation of an alternate embodiment, partially cut away.
Figure 11:
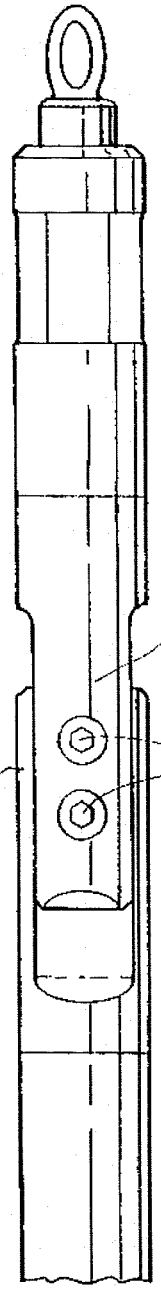
FIG. 11 is an enlarged side elevation of a portion of FIG. 10.
Figure 12:
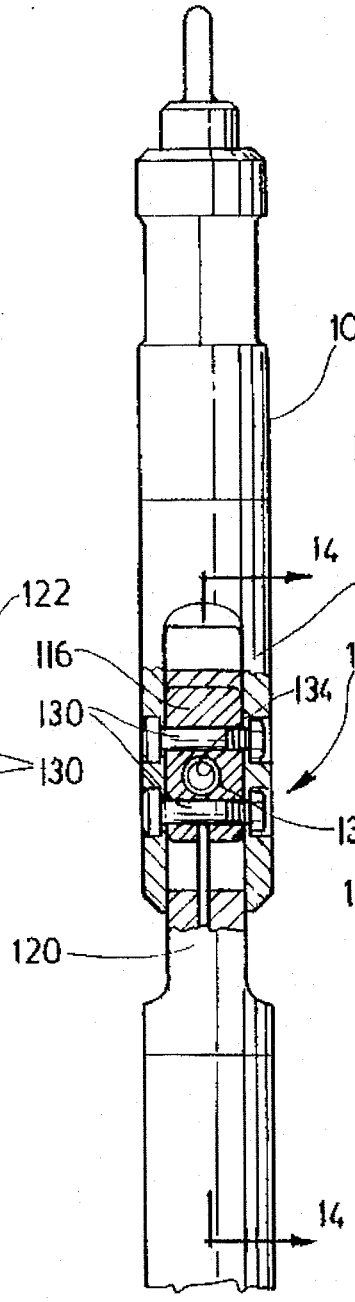
FIG. 12 is a side elevation corresponding to FIG. 11, rotated 90° degrees, in the power "off" position.
Figure 13:
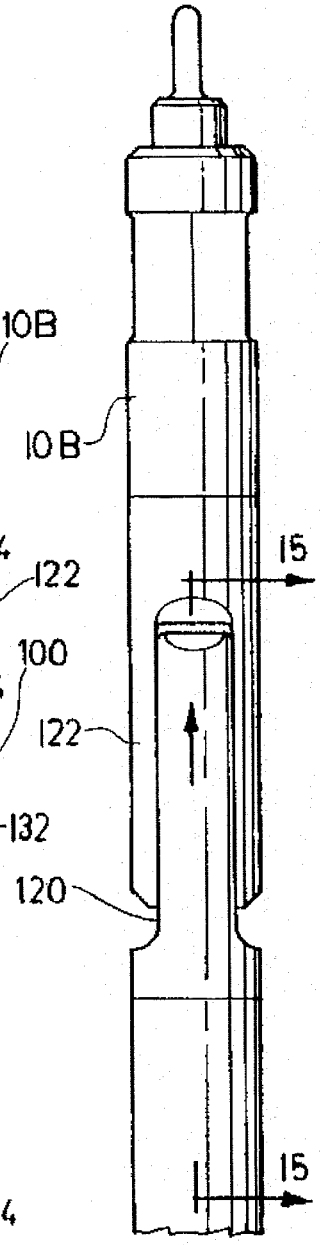
FIG. 13 is a side elevation corresponding to FIG. 12 in the power "on" position.

The trigger switch of this embodiment is shown in FIG. 9. Trigger switch 30 comprises a sleeve 80 containing a micro switch 82, a mass 84, in this case a brass weight, and a spring 86 urging the mass 84 away from the micro switch 82. A probe 88 on the end of the mass 84 is adapted to contact the button 90 on the micro switch, when the spring is compressed.

It will therefore be seen that the spring normally holds the micro switch open, thereby preventing flow of power to the sensing unit. The shock of the impact of the housing, when it is connected to the core barrel is such as to cause the mass 84 to drive downwardly against spring 86, and thus probe 88 will depress button 90 and cause operation of the micro switch, thereby initiating the delay circuit. After a suitable delay the circuit is closed, to permit a reading to be taken by the inclinometer unit.

In operation, core drilling proceeds in the normal way, with the hollow drill rods rotating, and the drill bit boring into the sub-strate. The drill core passes up through the drill bit into the core barrel, until the core barrel is full. The drill rods and core barrel incorporate a sensing system (not shown) which is well known in the art which detects when the core barrel is filled. Typically, in core drilling, the core barrel is approximately six feet in length. When the drill bit has descended six feet into the sub-strate, the core barrel will be filled. The signalling system used in drilling (not shown) which is well known in the art will then provide a signal for a halt in drilling, while the core barrel is removed. This is normally carried out by means of a wire line and a retrieval device, which is dropped down the interior of the drill rods and captures the top end of the core barrel and lifts it up.

All of this is well known in the drilling art and requires no further description.

In the use of the present invention, the upper end of the casing containing the inclinometer is attached to the wire line. The capture device is located at the lower end of the casing. The casing containing the inclinometer device is then lowered rapidly down through the drill rods, on the end of the wire line. When the capture device on the lower end of the casing strikes the upper end of the core barrel, it will engage and capture the abutment means on the upper end of the core barrel. At the same time, the shock caused by the impact of the casing on the core barrel will cause the trigger switch 30 to operate. This will then supply power to the delay circuit 74. After a suitable delay, which may be adjusted, depending upon the circumstances of the drilling operation, power is then supplied to the inclinometer sensor 20. The reading taken from the wire coil 40, by the contact 42 will then be passed to the constant current source 76, and then to the digital converter and memory 78.

The reading so taken is captured in the memory of the converter 78.

The wire line, casing 10, and the core barrel are then retrieved from within the drill rods and drawn up to the surface. The casing 10 is then disconnected from the core barrel. By manually operating the switch 28, the digital readout 26 is activated. A person can then read the digital readout 26 and note the inclination reading of the casing. This inclination reading is recorded in respect of the drill core located within the core barrel. Typically the core is then removed from the core barrel and placed in a container, for shipment to a laboratory.

Normally, several cores are removed and logged, and then placed in a large container before they are shipped to the laboratory. In this way, scientists at the laboratory can log the depth and also the inclination of each core.

This will then enable them to compose an accurate picture of the sub-strate being drilled.

At the drill site, the driller will then simply attach the empty core barrel to the wire line, and drop it down through the drill rods until it connects with the bottom end of the drill rods, close to the drill bit, in well known manner.

The wire line is then removed from the drill rods and drilling can continue.

It will thus be seen that by the use of the invention, accurate step-wise inclination readings can be taken in respect of each core as it is removed. It will also be seen that there is substantially no interruption in the usual sequence of drilling operations.

A further embodiment of the invention is illustrated in FIGS. 10 through 15.

In this embodiment, comprises a number of components which are common with the embodiment of FIGS. 1 through 9. Thus the alternate embodiment has a cylindrical housing 10A, a inclination sensor unit 20A, a power supply or battery 24A, and a visual readout 26A, all essentially similar to that described in the embodiment of FIGS. 1 through 9.

The principle difference in this embodiment is the on/off switch, which indicated generally as 100, is a positive locking switch which locks either "off" or "on".

In order to provide this function, there are provided a pair of electrical contacts 102, 104, mounted spaced apart from one another inside an interior insulated sleeve 106. The contact 102, 104 are connected through slip ring connections 108 to the power supply 24A, and to the inclination sensor unit 20A.

The contacts 102 and 104 are formed of resilient flexible metal, having a degree of spring recovery. They are formed with generally registering angled shoulders 110 defining a narrow throat.

In order to make and break the circuit between the contacts 102, and 104, a contact ring 112 is mounted on an operating rod 114. Ring 112 is, in its "off" position (FIG. 14) spaced a distance away from the shoulders 110. It is moveable, together with rod 114, to cause contacts 102, 104 to spring apart and to snap back again, into the "on" position (FIG. 15).

Movement of the rod 114 and ring 112 are controlled by means of a block 116.

In order to explain this function it is appropriate to point out that in this embodiment there is an upper cylindrical portion 10B which is moveable relative to the lower cylindrical portion 10A.

The lower cylindrical portion 10A is formed with a reduced width slide portion 120, and the upper cylindrical portion 10B is formed with a pair of sliding yokes 122—122 adapted to fit on either side of the slide portion 120.

Slide portion 120 is formed with a generally rectangular shaped central recess 124 (FIG. 14) extending from side to side thereof.

Within rectangular recess 124 there are formed two pairs of generally hemi-spherical locking recesses 126 and 128 for reasons to be described below.

Block 116 is slideably located in recess 124 and is secured between yokes 122—122 by means of bolts 130—130.

A through bore 132 is formed through block 116, and within it there is located a spring 134 and two locking members, in this case spherical balls 136—136.

The balls 136 are sized so as to make a good locking fit in recesses 126–128.

Comparison of FIGS. 14 and 15 will thus reveal that the rectangular recess 124 is of a greater length than the block 116. Consequently the slide member 120 can be slid relative to the block 116 and associated yokes 122.

It can be locked in two different positions (compare FIG. 14 and 15) by means of the balls 136 locking in recesses 126 or 128.

Rod 114 is secured in block 116.

Consequently, movement of slide portion 120 relative to block 116 will cause rod 114 and contact ring 112 to move inwardly through the restriction defined by the shoulders 110 of the contacts 102, and 104, causing the contacts to spread and then close again (compare FIG. 15).

This will thus provide a positive make and break switching connection.

In operation, the switch is normally in the "off" position (FIG. 14) with yokes 122 extended relative to slide portion 120.

When the instrument is lowered down the bore hole, to capture the core barrel in the same manner as in relation to the embodiment of FIGS. 1 through 9, the dropping of the instrument against the top of the core barrel will cause the upper portion 10B to slide downwardly relative to the lower portion 10A into the position shown in FIG. 15.

This will then cause switching "on" of the power to the sensor, and power will remain switched on until such time as tension is applied to the wire line (not shown) on which the instrument is suspended. When tension is applied to raise the instrument and core barrel, then sliding action will take place in the reverse direction into the position of FIG. 14, thereby switching power "off".

By this time however the necessary measurements will have been taken and stored in the memory (FIG. 8), and can then be read out when the instrument is withdrawn to the surface.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A bore hole inclinometer device adapted for use in core drilling employing hollow drill rods, and a core barrel, and said device comprising;

an elongated casing dimensioned to fit within said hollow drill rods, and having at its lower end means for attachment to said core barrel, and having at its upper end, hoist attachment means whereby said casing and said core barrel may be hoisted and lowered through said hollow drill rods;

inclination sensing means within said casing, operable to respond to the inclination of said casing to provide a reading of the inclination of said casing;

electrical sensing means for sensing said inclination of said casing, and providing an inclination signal proportional to said inclination of said casing;

electrical circuit means for powering said sensing means, and for receiving said inclination signal;

electrical power supply means for powering said electrical circuit means;

switch means comprising a pair of contacts connecting said power supply means to said circuit means and being relatively moveable to one another and being normally out of contact;

a contact member moveable relative to said contacts, to make the circuit between said contracts;

first and second casing portions defined by said casing, by means of which said upper end of said casing and said lower end are moveable to one another, and, means on one said casing portion for moving said contact member into contact with said contacts.

2. A bore hole inclinometer device as claimed in claim 1 including a digital display for displaying the inclination of said device.

3. A bore hole inclinometer device as claimed in claim 2 including a switch for activating and de-activating said digital display.

4. A bore hole inclinometer device as claimed in claim 1 wherein said inclination signal is an analogue signal, and wherein said electrical circuit means includes means for converting said analogue signal to a digital signal, and memory means for capturing said digital signal.

5. A bore hole inclinometer device as claimed in claim 1, and including locking means interengageable between said first and second casing portions, whereby to releasably lock the same in at least one position relative to one another.

6. A bore inclinometer device as claimed in claim 5, and including a slide member on one of said first and second casing portions, and yoke portions on the other of said first and second casing portions, said yoke portions being adapted to make a sliding fit with said slide member, and a slide block secured between said yoke members, and a recess in said slide member, for receiving said slide block and making a sliding fit in said recess, said locking means being located in said slide block and being interengageable with said yoke members.

* * * * *